US009753476B1

(12) United States Patent
Shukla et al.

(10) Patent No.: US 9,753,476 B1
(45) Date of Patent: Sep. 5, 2017

(54) VOLTAGE REGULATOR WITH FAST OVERSHOOT SETTLING RESPONSE

(71) Applicant: SanDisk Technologies Inc., Plano, TX (US)

(72) Inventors: Hemant Shukla, Bangalore (IN); Saurabh Kumar Singh, Bangalore (IN)

(73) Assignee: SanDisk Technologies LLC, Plano, TX (US)

( * ) Notice: Subject to any disclaimer, the term of this patent is extended or adjusted under 35 U.S.C. 154(b) by 0 days.

(21) Appl. No.: 15/099,491

(22) Filed: Apr. 14, 2016

(30) Foreign Application Priority Data

Mar. 3, 2016 (IN) ..... 201641007443

(51) Int. Cl.
*G05F 1/00* (2006.01)
*G05F 1/575* (2006.01)
*G05F 1/56* (2006.01)

(52) U.S. Cl.
CPC ..... *G05F 1/575* (2013.01); *G05F 1/562* (2013.01)

(58) Field of Classification Search
CPC . G05F 1/575; G05F 1/56; G05F 1/573; G05F 1/465; G05F 1/468; G05F 1/462; G05F 1/562; G05F 1/565; G05F 1/567; G05F 1/569; G05F 1/571; G05F 1/5735; H02M 2001/0045
USPC ..... 323/273–281
See application file for complete search history.

(56) References Cited

U.S. PATENT DOCUMENTS

| | | | | |
|---|---|---|---|---|
| 6,201,375 | B1 * | 3/2001 | Larson | G05F 1/573 323/277 |
| 6,388,433 | B2 | 5/2002 | Marty | |
| 6,853,565 | B1 | 2/2005 | Liao | |
| 7,402,987 | B2 | 7/2008 | Lopata | |
| 7,471,567 | B1 | 12/2008 | Lee et al. | |
| 7,982,445 | B1 | 7/2011 | Xin-LeBlanc | |
| 7,982,448 | B1 | 7/2011 | Prasad et al. | |
| 8,054,132 | B2 | 11/2011 | Noh | |
| 8,072,198 | B2 | 12/2011 | Imura | |
| 8,436,595 | B2 | 5/2013 | Simmons et al. | |
| 8,581,498 | B1 | 11/2013 | Cheung et al. | |
| 8,797,008 | B2 | 8/2014 | Devegowda | |
| 2007/0030054 | A1 * | 2/2007 | Lee | G05F 1/571 327/541 |

(Continued)

OTHER PUBLICATIONS

Sharer, Deborah, "Section G5: The Typical Op-Amp," [http://www.coefs.uncc.edu/dlsharer/files/2012/04/G5.pdf], May 20, 2004, 5 pages.

(Continued)

*Primary Examiner* — Nguyen Tran
(74) *Attorney, Agent, or Firm* — Vierra Magen Marcus LLP

(57) ABSTRACT

A voltage regulator circuit is provided in which voltage overshoots are quickly dissipated using a discharge path which is connected to an output of the voltage regulator. Circuitry for controlling the discharge path is provided using internal currents of an error amplifier to provide a space-efficient and power-efficient design with a fast response. Moreover, hysteresis can be provided to avoid toggling between discharge and no discharge, and to avoid under-shoot when discharging the output. A digital or analog signal is set which turns the discharge transistor on or off. A current pulldown may be arranged in the discharge path.

16 Claims, 11 Drawing Sheets

(56) References Cited

U.S. PATENT DOCUMENTS

| | | | |
|---|---|---|---|
| 2009/0212862 | A1 | 8/2009 | Kuroki |
| 2010/0156362 | A1 | 6/2010 | Xie |
| 2010/0156533 | A1 | 6/2010 | Tachibana et al. |
| 2015/0097534 | A1 | 4/2015 | Bhattad |
| 2015/0198960 | A1 | 7/2015 | Zhang et al. |
| 2015/0214838 | A1 | 7/2015 | Tomioka et al. |

OTHER PUBLICATIONS

Rogers, Everett, "Stability analysis of low-dropout linear regulators with a PMOS pass element," Texas Instruments Incorporated, Aug. 1999, 10 pages.

Rumrill, R.S., "Error Amplifier Design and Applications," Technical Note #3, Oct. 18, 2001, 6 pages.

Lee, Bang S., "Understanding the Terms and Definitions of LDO Voltage Regulators," Texas Instruments, Application Report, SLVA079, Oct. 1999, 13 pages.

Texas Instruments, "Linear and Switching Voltage Regulator Fundamentals," Literature No. SNVA558, Dec. 7, 2011, 31 pages.

Whites, Keith W., "Lecture 36: MOSFET Common Drain (Source Follower) Amplifier," [http://www.whites.sdsmt.edu/classes/ee320/notes/320Lecture36.pdf], Dec. 2009, 10 pages.

Allen, P.E., "Lecture 060—Push-Pull Output Stages (Reading: GHLM—365-384, AH—226-229," ECE 6412—Analog Integrated Circuits and Systems II, Jan. 11, 2004, 10 pages.

* cited by examiner

VOLTAGE REGULATOR WITH FAST OVERSHOOT SETTLING RESPONSE

BACKGROUND

The present technology relates to voltage regulators.

In semiconductor technology, electronic devices often require regulated voltages to operate properly. Typically, a supply voltage of a semiconductor chip is provided to a voltage regulator which can translate the voltage to an output voltage at different levels. Various types of voltage regulators can be used. Moreover, a voltage regulator can include voltage regulation circuitry to maintain the output voltage at a constant level.

DETAILED DESCRIPTION

Figure 1:
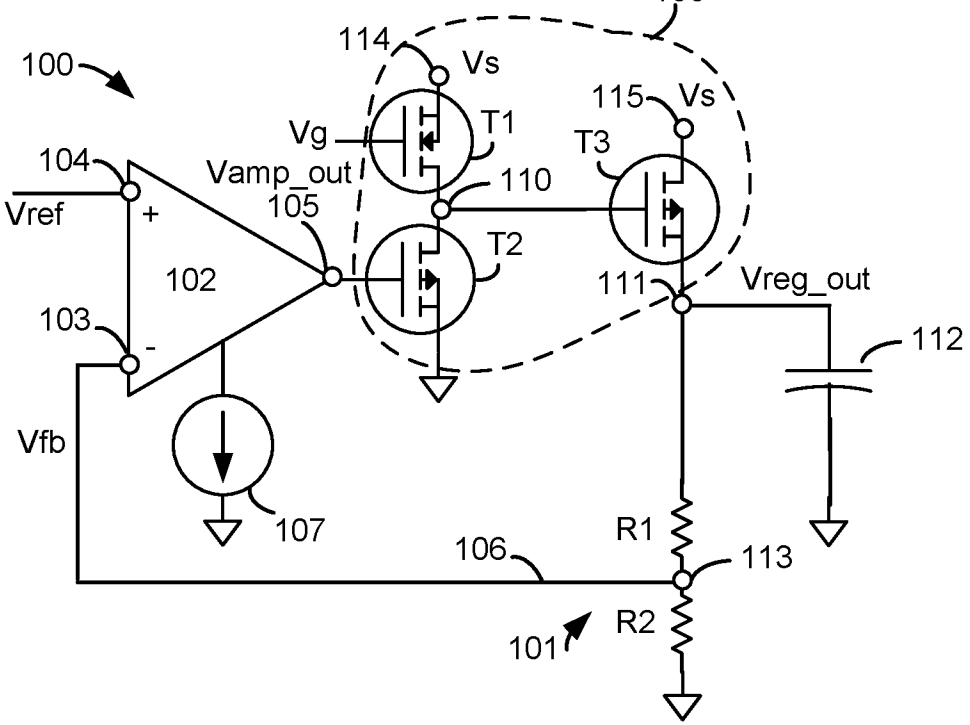
FIG. 1 depicts an example of a voltage regulator circuit in which an overshoot voltage is discharged by a resistive divider network.

A voltage regulator circuit is provided in which voltage overshoots are quickly dissipated so that a regulated output voltage can be maintained. Corresponding methods for operating a voltage regulator are also provided.

Electronic devices often require regulated voltages to operate properly. Typically, a supply voltage of the device is provided to a voltage regulator which can translate the voltage to an output voltage at different levels. A voltage regulator may include an error amplifier which receives a reference voltage and feedback signal. Based on the difference between the two input, and output voltage is provided.

The output from the error amplifier may be used to control a power transistor which provides a final output voltage to a load. For example, in a memory device, the load can represent, e.g., one or more word lines, bit lines or source lines. These are examples of capacitive loads, which do not consume current. Another type of load is a direct current (DC) load, which consumes current.

Various types of voltage regulators can be used. One type is a linear voltage regulator, which provide a constant DC output voltage and contains circuitry that continuously holds the output voltage at the design value regardless of changes in load current or input voltage. Examples include the standard (NPN Darlington) regulator, a low dropout (LDO) regulator and a quasi LDO regulator. The LDO regulator has the smallest dropout voltage across it, so that it dissipates the least internal power, while the standard (NPN Darlington) regulator has the largest dropout voltage across it. However, the LDO regulator has a higher ground pin current.

A voltage-controlled current source may be used to force a fixed voltage to appear at the output terminal of the voltage regulator. The control circuitry senses the output voltage and adjusts the current source to hold the output voltage at the desired value. The output voltage is controlled using a feedback loop.

However, due to the proximity of the output node of the voltage regulator to other components in a semiconductor device, the output voltage may temporarily be coupled higher due to capacitive coupling from a conductive line. For example, a step or ramp change in a voltage of such a line can cause a temporary overshoot of the output voltage above its regulated level. This can interfere with the components which act as the load. For example, if the voltage of a word line in a memory device changes suddenly and unexpectedly, a read or write operation which is performed on memory cells connected to the word line can be affected. The likelihood of such coupling becomes higher as semiconductor devices become denser. Due to the coupling, many voltages in the device can be altered so that performance is degraded.

Techniques and apparatuses provided herein address the above and other issues. In one approach, a discharge path is provided for the output of the voltage regulator to quickly discharge an overshoot voltage. Moreover, circuitry for controlling a discharge path for the output of the voltage regulator is provided using internal currents of the amplifier to provide a space-efficient and power-efficient design with a fast response. In a further aspect, hysteresis is provided to avoid toggling between discharge and no discharge, and to minimize undershoot when discharging the output.

FIG. 1 depicts an example of a voltage regulator circuit 100 in which an overshoot voltage is discharged by a resistive divider network 101. The circuit includes an error amplifier 102 which has an inverting input 103, a non-inverting input 104 and an output node 105. The inverting input receives a feedback voltage, Vfb, on a feedback path 106, and the non-inverting input receives a fixed reference voltage, Vref. The output node has a voltage Vamp_out. The error amplifier is powered by a current source 107. The output of the error amplifier controls a power stage 108 comprising one or more power MOSFETs or other transistors T1, T2 and T3. A power MOSFET is a specific type of MOSFET designed to handle significant power levels. The power stage can provide Vreg_out at a different, e.g., higher, level than Vamp_out. The power device can be, e.g., an nMOS, pMOS, bipolar junction transmitter (BJT) or a Darlington Pair.

In this example, T1 is a pMOSFET (a p-type metal-oxide-semiconductor field-effect transistor and T2 and T3 are nMOSFETs (n-type). The source of T1 is connected to a supply voltage Vs (e.g., the supply voltage of a semiconductor chip) at a node 114. The source of T3 may also be connected to Vs or other voltage at a node 115. The drain of T1 is connected to a node 110. The gate of T1 is connected to a gate voltage Vg. The drain of T2 is connected to the node 110. The source of T2 is connected to ground. The gate of T2 is connected to the output node 105 of the error amplifier. Thus, with a given Vg and Vs, Vamp_out controls the current at the node 110. T1 and T2 are arranged in a push-pull configuration. For example, T1 can pull up the voltage at the node 110 to Vs, and T2 can pull down the voltage of the node 115 to ground. Vs may be higher than Vdd in the error amplifier, e.g., 4-5 V vs. 1-2 V (see FIGS. 5 and 6).

Based on the current at the node 110, which is the gate of T3, a voltage is provided at this gate which controls an amount of Vs which is passed to the output node 111 of the voltage regulator. This is the regulated voltage Vreg_out which is provided to a capacitive load 112. The resistive divider network 101 includes resistors R1 and R2, so that the voltage at an output node 113 of the divider is the feedback voltage Vfb=Vreg_out*R2/(R1+R2).

If a voltage overshoot occurs in Vreg_out, it will eventually be discharged through the resistive divider network due to the pull-up and pulldown action of T1 and T2. However, the pull-up and pulldown action is usually asymmetric. That is, the voltage regulator discharge is usually limited by the maximum current supported by the resistive divider network present. Since the resistance is typically very high, e.g., in the hundreds of kilo ohms to mega ohm range, the discharge current will be relatively small and the discharge time relatively long. That is, the high resistive path required to lower the quiescent current makes the discharge on the output node very slow. The asymmetry is due to the pull up and pull down difference. The charging of the output node is done through an active device (e.g., a MOSFET) but the discharge is usually through a resistive divider which is designed with a very large resistance to save the quiescent current In a steady state operation, the error amplifier will provided an amplification which maintains Vfb≈Vref. Further, the voltage dropped across R2 equals Vref Thus, Vref=Vfb=Vreg_out*R2/(R1+R2) or Vreg_out=Vref*(R1+R2)/R2.

Figure 2:
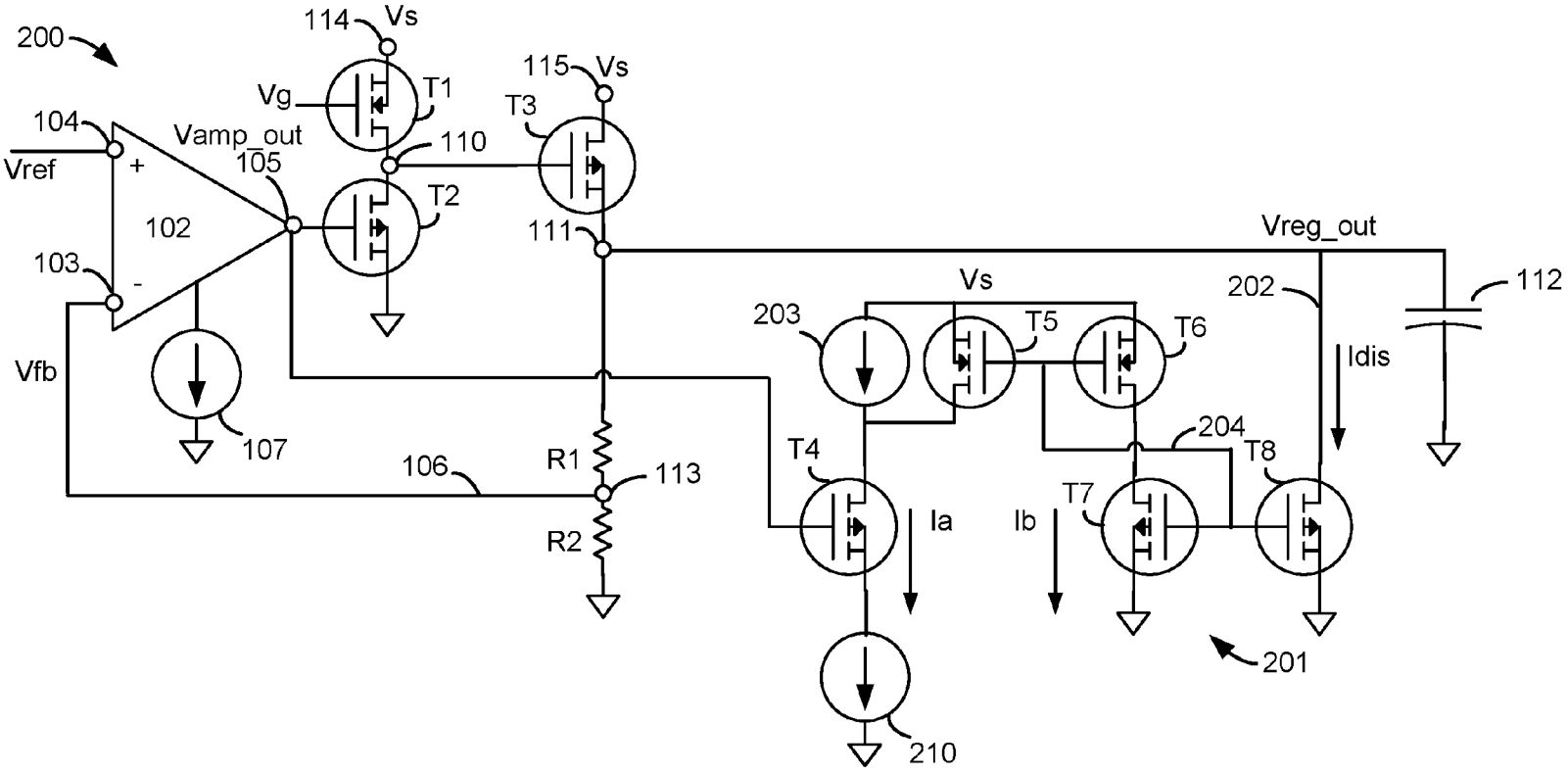
FIG. 2 depicts an example of a voltage regulator circuit in which an overshoot voltage is discharged using a current comparator which is external to an error amplifier.

FIG. 2 depicts an example of a voltage regulator circuit 200 in which an overshoot voltage is discharged using a current comparator which is external to an error amplifier 102. To reduce an overshoot more quickly, a current comparator 201 can be used with a discharge transistor T8 as a switch in a discharge path 202. In some cases, the current comparator is always on to discharge current from the output node 111. However, this results in a high quiescent current to ground. Another approach is to selectively turn on the current comparator based on the level of Vamp_out. Circuitry is provided which compares currents on the basis of the output of the error amplifier, then mirrors the current to pull down the output node. For example, a current source 203 and a current sink 210 may be arranged in a path with a transistor T4. The gate of the T4 is connected to the output 105 of the error amplifier. When Vamp_out goes high, a current Ia flows through T4. Transistor T5 and T6 are arranged in a mirror configuration so that a current Ib flows through T6 and T7. Transistor T7 and T8 are also arranged in a mirror configuration. A path 204 connects the gates of T5 and T6 with the gates of T7 and T8. Based on the current in this path, T8 is made conductive so that a discharge current flows from the output node 111 to ground. When Vamp_out subsequently decreases, the discharge current stops.

However, this approach has a relatively slow response. Moreover, it is not space efficient due to the additional circuitry, is not generic and lacks hysteresis. Hysteresis is not provided because the turn on and turn off thresholds for T8 are the same, e.g., the turn on threshold is Vamp_out>0 and the turn off threshold is Vamp_out<=0. This can result in toggling between the turn on (conductive) and turn off (non-conductive) states.

Figure 3:
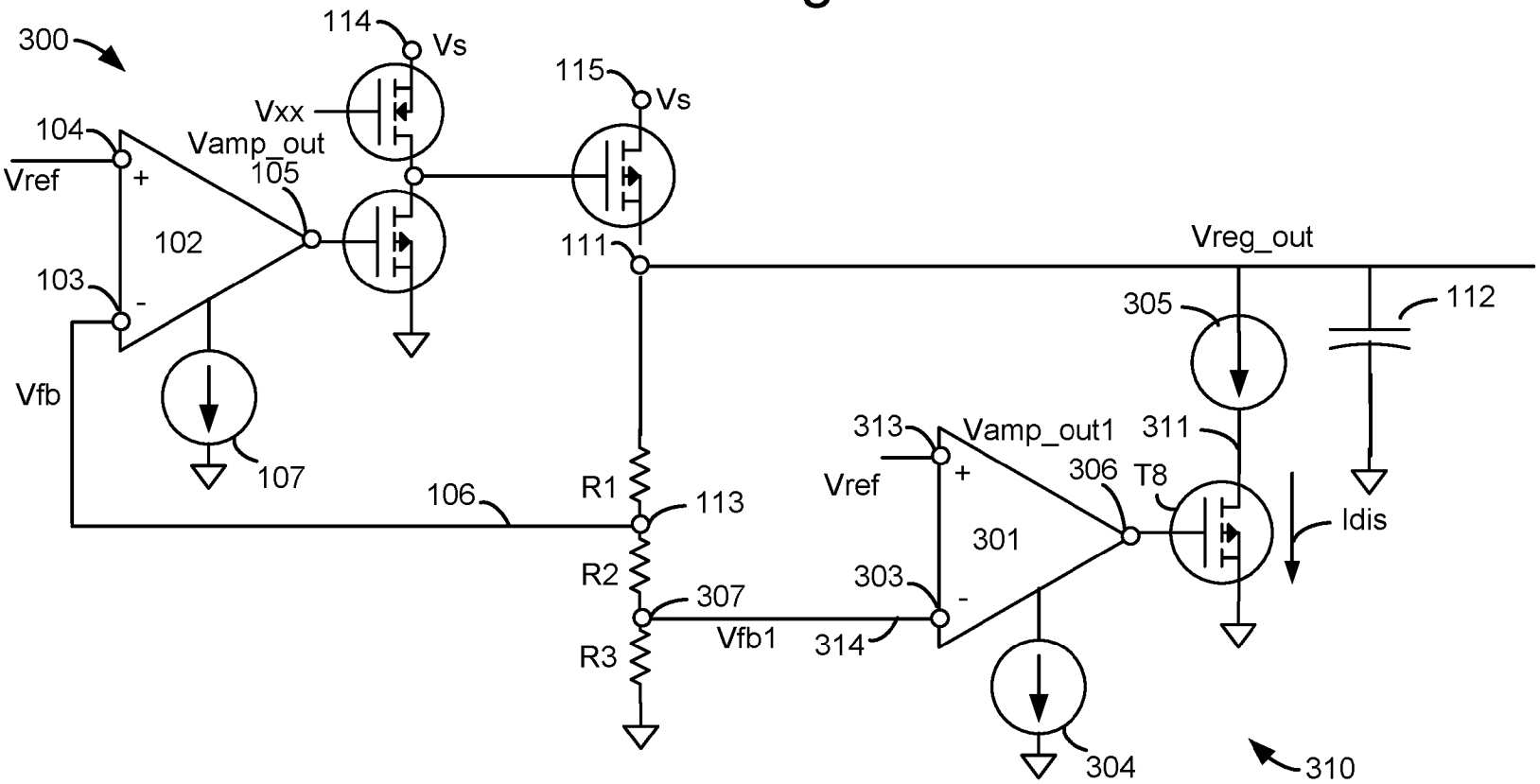
FIG. 3 depicts an example of a voltage regulator circuit in which an overshoot voltage is discharged using a voltage comparator which is external to an error amplifier.

FIG. 3 depicts an example of a voltage regulator circuit 300 in which an overshoot voltage is discharged using a voltage comparator which is external to an error amplifier. In this approach, a voltage based-comparator 310 is used. The comparator includes an error amplifier 301 which has an inverting input 303, a non-inverting input 313 and an output node 306. The inverting input receives a feedback voltage, Vfb1, on a feedback path 314 from an output node 307 of a resistor divider, and the non-inverting input receives the fixed reference voltage, Vref. The output node has a voltage Vamp_out1. The error amplifier is powered by a current source 304. The output of the error amplifier controls the transistor T8. When Vamp_out1 increases beyond a threshold, the discharge path 311 is enabled is triggered and the output node 111 of the voltage regulator is pulled down using a current sink 305. In this approach, Vfb=Vreg_out*(R2+R3)/(R1+R2+R3), and Vfb1=Vreg_out*R3/(R1+R2+R3), However, this approach is not space efficient due to the additional circuitry. Also, there is an additional current consumption required by the comparator, and hysteresis is not provided in this example.

Figure 4:
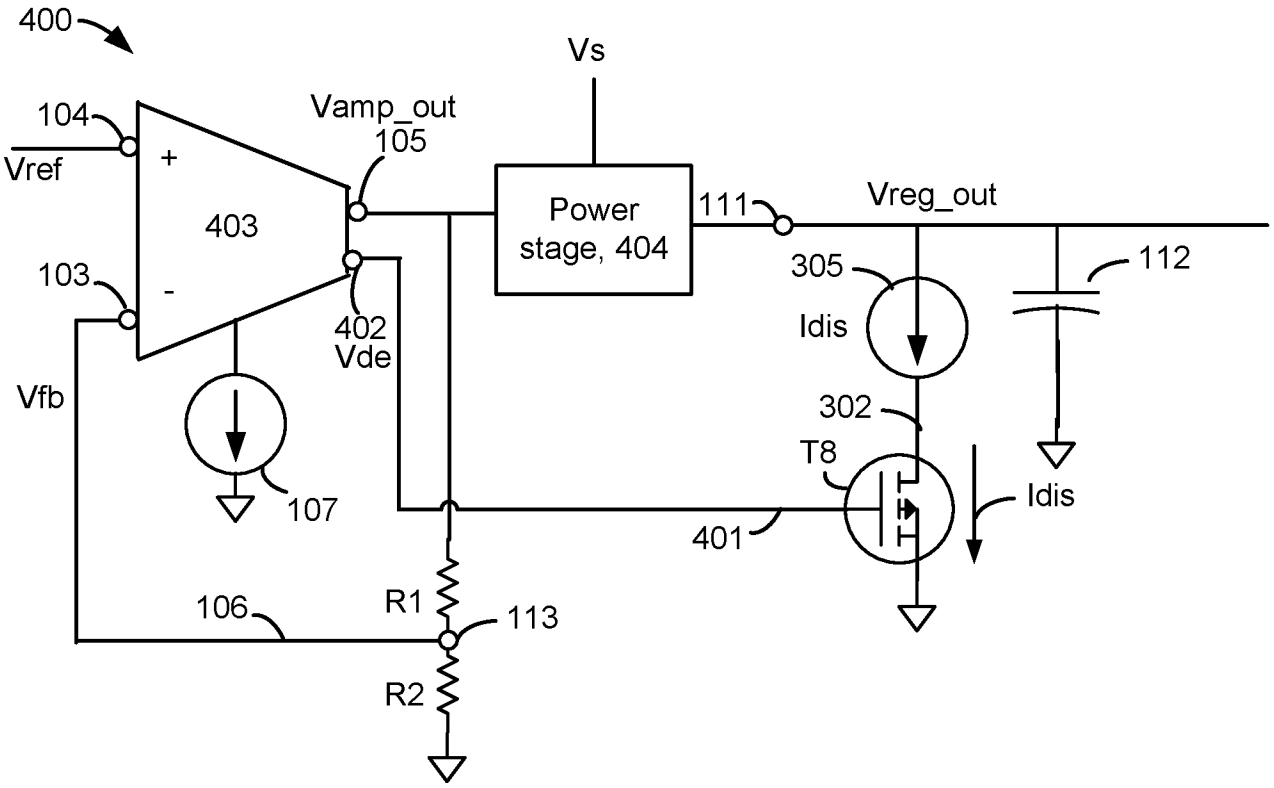
FIG. 4 depicts an example of a voltage regulator circuit in which an overshoot voltage is discharged using a discharge control circuit which is combined with an error amplifier.

FIG. 4 depicts an example of a voltage regulator circuit 400 in which an overshoot voltage is discharged using a discharge control circuit which is combined with an error amplifier. In this case, a combined circuit 403 (a combination of an error amplifier and a discharge control circuit) is used which has two outputs. A first output node 105 provides Vamp_out to a power stage 404 (such as the power stage 108 in FIG. 1). Vreg_out is output from the power stage. A second output node 402 provides a voltage Vde (de=discharge enable) to the discharge transistor T8. Both outputs are provided using the same feedback loop of the error amplifier, without disturbing the feedback loop. The combined circuit is provided by modifying the error amplifier so that the differential pair (the inverting and non-inverting inputs) is reused as an input pair for the discharge control circuit. The current comparison can be done based on the voltage feedback, Vfb. If Vfb exceeds Vref by a certain threshold, which is a design parameter, Vde is active high. Vde is the gate voltage of T8 on a path 401, so that T8 becomes conductive and allows the discharge current Idis to flow in the discharge path 311. The current sink provides a discharge current, Idis. The magnitude of Idis is a design parameter and is responsible for the speed of the discharge. Idis can be any selected level, and does not have to be the same as the Iref of the error amplifier in FIG. 5, for instance. Idis controls the discharge behavior with different process, voltage and temperature (PVT) variations.

Current is discharged from the output node 111, thereby reducing Vreg_out from its overshoot level to its regulated level (Vreg). The modified error amplifier acts like a comparator without impacting the main feedback loop. Further, hysteresis can be provided to minimize or avoid an undershoot which follows the discharge. Hysteresis is desirable to avoid false triggering of the discharge path due to any noise injection at the comparator input.

The minimum undershoot design is done by creating a systematic offset, which is a design parameter. For example, a turn on threshold for T8 (the voltage which Vamp_out or Vfb must exceed for T8 to turn on, to enable the discharge) can be different than a turn off threshold (the voltage which Vamp_out or Vfb must subsequently fall below for T8 to turn off, to disable the discharge). In one approach, the turn on threshold is lower than the turn off threshold. See also FIG. 6.

Figure 5:
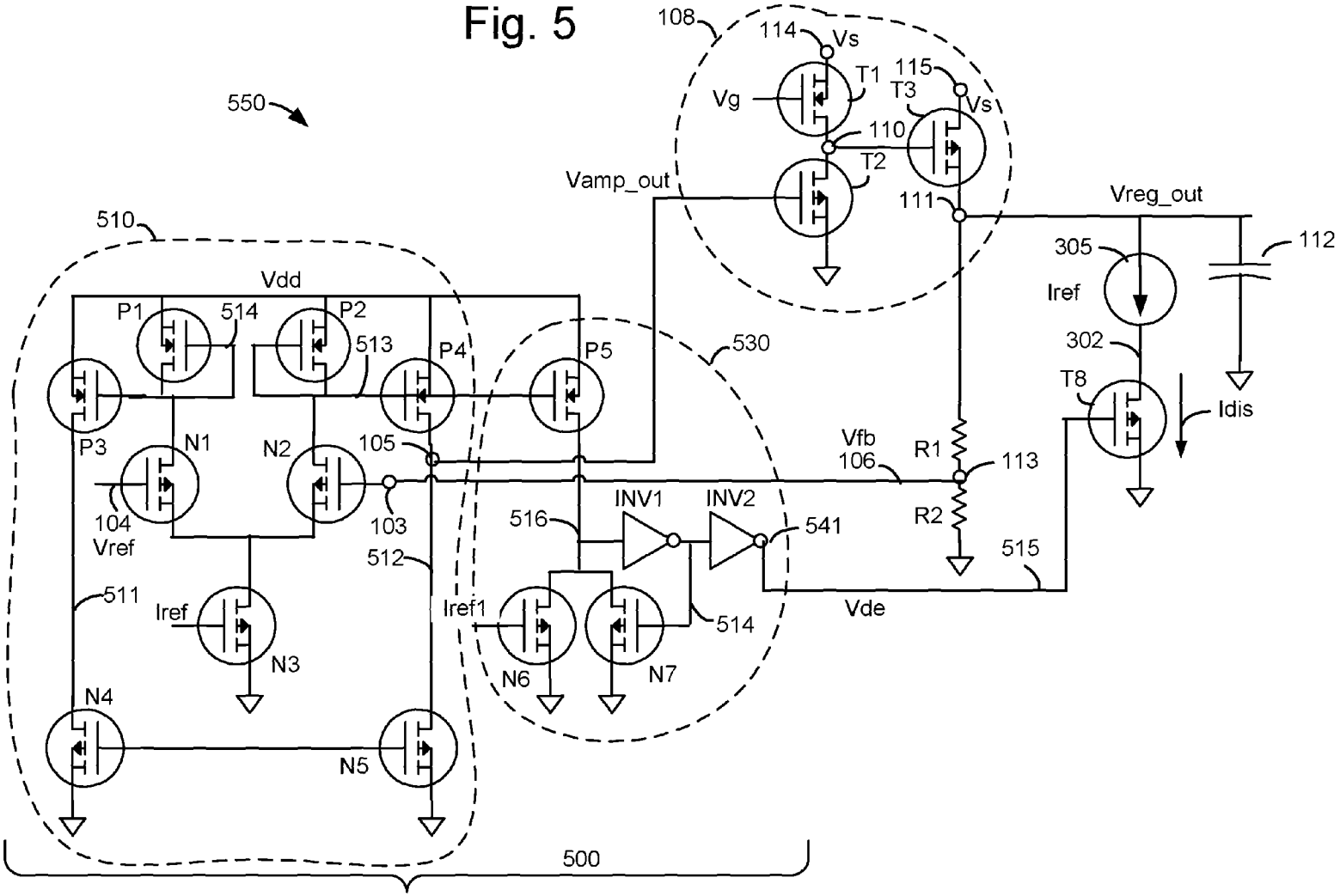
FIG. 5 depicts an example implementation of the circuit of FIG. 4.

FIG. 5 depicts an example implementation of the circuit of FIG. 4. In a voltage regulator circuit 550, a combined circuit 500 includes an error amplifier 510 and a discharge control circuit 530. The error amplifier here is a two stage push-pull amplifier but other configurations may be used. A number of pMOSFETs are provided and labelled P1-P5. A number of nMOSFETs are provided and labelled N1-N5. P4 and N5 are arranged in a push-pull configuration, relative to the path 512, P4 is a pull up transistor and N5 is a pulldown transistor. A supply voltage Vdd is provided for the combined circuit. A reference current Iref for the error amplifier is provided by N3. Vref controls a current flow through N1 and P1 while Vfb controls a current flow through N2 and P2. The gates of P1 and P3 are connected to the drain of N1 by a path 514, while the gates of P2, P4 and P5 are connected to the drain of N2 by a path 513. The gates of N4 and N5 are connected to one another, while the drain of N4 is connected to the drain of P3 by a path 511, and the drain of N5 is connected to the drain of P4 by a path 512. The output node 105 of the error amplifier is in this path.

The discharge control circuit comprises P5, N6 and N7 and inverters INV1 and INV2 (two inverter high gain stages). A current through P2 or P4 is mirrored to P5 and compared to a reference current, Iref1, which can be the same or different than the Iref of N3. The drain of P5 is connected to the drains of N6 and N7 by a path 515. The current through N7 is based on a gate voltage at a path 514 which is connected between the inverters, e.g., between the output to INV1 and the input to INV2. The inverters switch from a low output to a high output if their input voltage is sufficiently high. An output of INV2 at a path is therefore a flag with a high (e.g., a logical 1) or low (e.g., a logical 0) value. The path 516 is an input to INV1, the path 514 is an output of INV1 and an input to INV2 and the path 515 is an output of INV2.

Due to a systematic offset which is provided, the path 515 is at 0 V in normal conditions, when there is no overshoot in Vreg_out, or at least no overshoot which exceeds a threshold. When Vreg_out and hence Vfb goes high beyond a first level (a design parameter decided by the offset condition), the current in P2 increases. Due to the mirroring of the current to the path 512 via P4, this current is compared to the reference current Iref1 plus an offset. The offset is provided by the path 514 being in a high state and causing a current in N7. If the current exceeds Iref1 plus an offset (e.g., the current increase above a first threshold), INV1 changes its output to the low level. In turn, INV2 changes its output to the high level, causing T8 to become conductive and enabling the discharge path 311. A discharge current from the output node 111 to ground is generated, quickly reducing the overshoot of Vreg_out. Subsequently, the overshoot decreases.

The offset provided by N7 is not present when the discharge path is enabled, so the current on path 512 is compared to Iref1. That is, N7 is turned off when the voltage on the path 514 is low. When Vreg_out decreases, Vfb also decreases and hence the current in P2 decreases. This current will be pulled down at a difference strength than when the discharge path was off. When the current falls below a second threshold, INV1 will flip again to output a high value. In turn, IN2 will output a low value and the discharge path will be turned off. Due to this hysteresis, toggling of T8 due to noise is avoided.

The current comparison thus involves a current pull up by P5 and a current pull down by N6 and N7, or N6 alone. Assume the currents are as follows: I(P5), I(N6) and I(N7). The first threshold above is I(N6)+I(N7). The first threshold above is I(N6).

Accordingly, an apparatus is provided which includes an error amplifier comprising an inverting input 103, a non-inverting input 104 and an output 105, the non-inverting input configured to receive a reference voltage and the inverting input configured to receive a feedback signal based on a voltage of the output (Vreg_out); a power stage 108 connected to the output of the error amplifier; an output node 111 connected to the power stage and to a load 112; a discharge path 311 connected to the output node; and a control circuit 530 configured to enable the discharge path in response to the current in the error amplifier (IP5)) satisfying a threshold (I(N6)+I(N7)), and disable the discharge path in response to the current in the error amplifier satisfying a threshold (I(N6)).

The discharge control circuit 530 comprises a pair of inverters INV1 and INV2, and a current sink (formed by N6 and N7) connected to an input (path 516) to the pair of inverters. The current sink is configured to sink a first current (I(N6)+I(N7)) when the discharge path is enabled and to sink a second current (I(N6)) when the discharge path is disabled. The current (I(P5)) in the error amplifier on the path 516 is a current source to the path (input) 516 to the pair of inverters.

The current sink formed by N6 can be considered to be a fixed current sink and the current sink formed by N7 can be considered to be a switchable current sink, since it changes with the high or low value on the path 514. The switchable current sink is connected to the path 514 which is between the inverters; the path between the inverters is high when the discharge path is disabled and low when the discharge path is disabled; when the path between the inverters is high, the switchable current sink is configured to sink a first current (since the gate voltage is high); and when the path between the inverters is low, the switchable current sink is not configured to sink a current (since the gate voltage is low).

Further, the current in the error amplifier mirrors a current source (via P2) to the output (105) of the error amplifier, and the current at the output of the error amplifier is in a path 512 comprising push-pull transistors (P4, N5).

An apparatus is also provided which includes an error amplifier, the error amplifier comprising a first output 105, a second output 541, an inverting input and a non-inverting input; a power stage connected to the error amplifier and to an output node; and a discharge path connected to the output node, wherein the first output is configured to control the power stage and the second output is configured to control the discharge path.

Note that the techniques described herein are not limited to the specific voltage regulator architectures shown but can be used with any regulators having similar specifications. The comparator has a systematic offset and the residue discharge is done through the resistive network only. This ensures that the proposed solution will not cause any undershoot.

Figure 6:
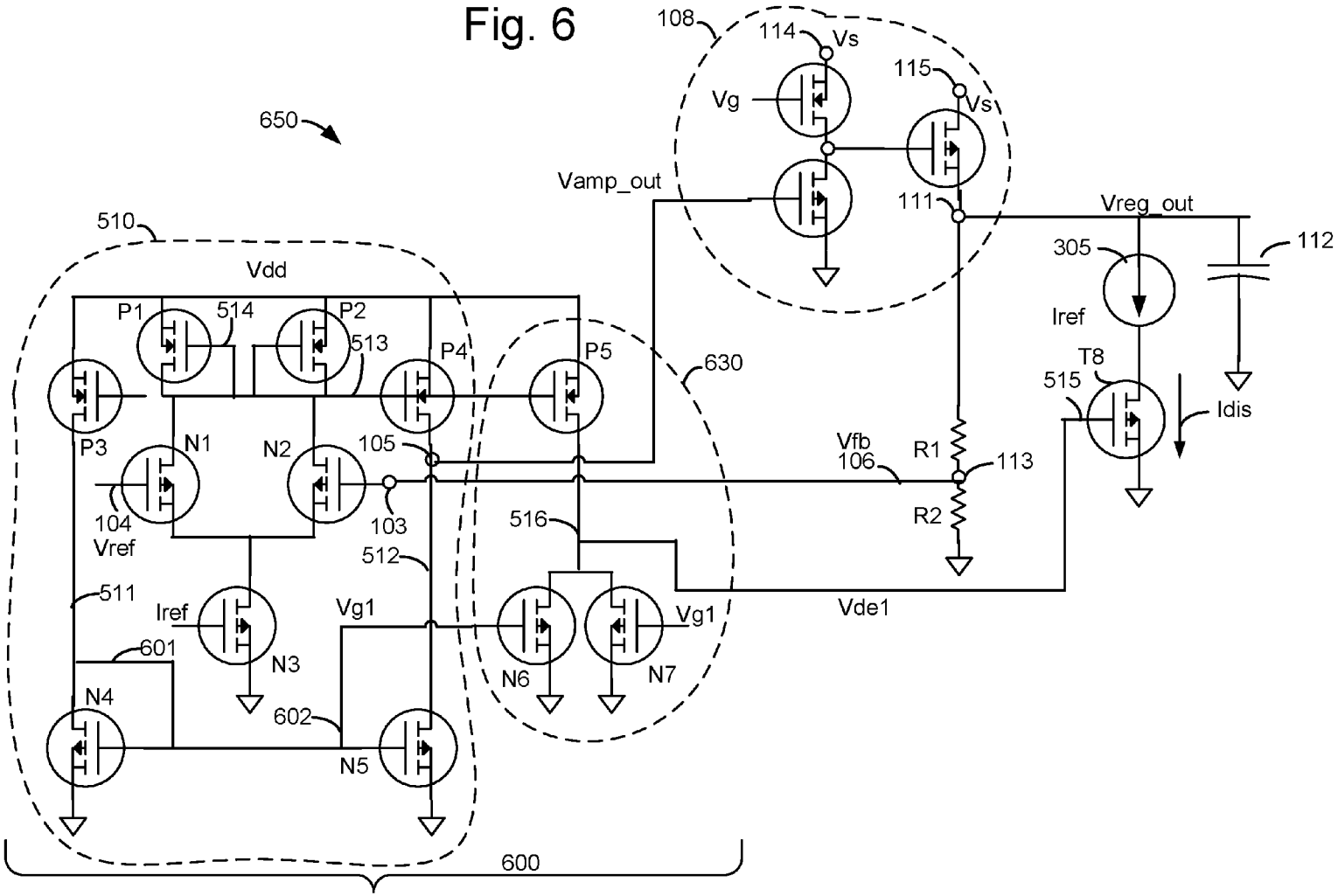
FIG. 6 depicts another example implementation of the circuit of FIG. 4.

FIG. 6 depicts another example implementation of the circuit of FIG. 4. In a voltage regulator circuit 650, a combined circuit 600 includes the error amplifier 510 of FIG. 5 and a discharge control circuit 630. In this example, the inverters are omitted. The current sink in the discharge path is also omitted. Additionally, a path 601 connects the gate of N4 with its drain, and a path 602 connects the gate of N5 with the gate of N6. A voltage Vg1 of N6 provides a current through N6. The path is extended to the gate of N7 as well. The path 516 has a voltage Vde1. This voltage is provided on a path 515 to control the discharge transistor T8. Vde1 can have a range of analog values instead of being a binary flag with high and low values, or other digital flag. The level of Idis varies according to Vde1.

The current in P5 is compared with a current in the N4. This means the discharge current is a feature of the closed loop and, hence, hysteresis is not used. N7 provides an extra offset current in FIG. 5. The path 515 is at 0 V when there is no overshoot in Vreg_out. When Vreg_out and hence Vfb increases, the current in path 516 increases. This current is compared to a current at N6 plus an offset provided by the current in N7. If the current exceeds this compared to level, Vde1 increases, causing T8 to become conductive and enabling the discharge path 302. The conductivity of T8 can be proportional to Vde1 so that Idis is also proportional to Vde1.

The current in N7 and N8 is not Iref but is the mirror of the current in N4. It is ratioed in similar way as described above.

Thus, rather that setting a binary or other digital flag, an analog signal is provided that turns on or off the discharge path to ground. The circuit of FIG. 5 sets a digital signal that turns on or off the discharge path to ground.

Figure 7A:
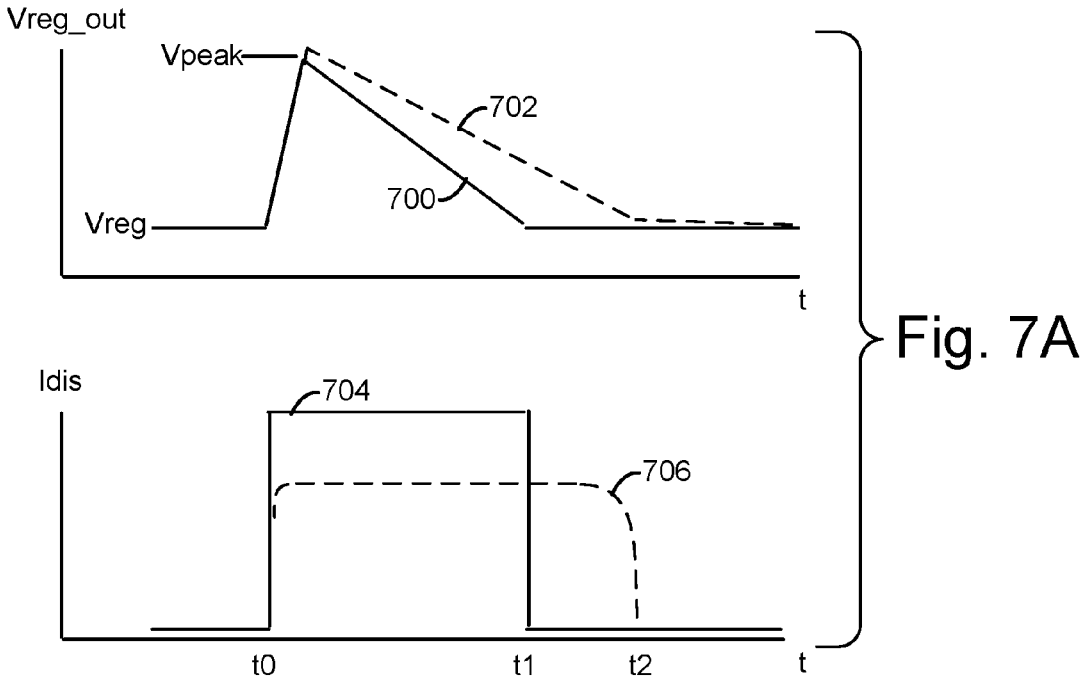
FIG. 7A depicts example waveforms showing discharge of a voltage overshoot.

FIG. 7A depicts example waveforms showing discharge of a voltage overshoot. Simulation results are shown. A plot 700 is provided using the circuits of FIGS. 5 and 6. A plot 702 is a comparative example. The vertical axis represents voltage and the horizontal axis represents time. Before a time t0, the output, Vreg_out is at a regulated level, Vreg. At t0, Vreg_out begins to overshoot, e.g., due to coupling from another conductive path. Vreg_out increases to a peak level, Vpeak, then decreases and eventually stabilizes at Vreg. Plots 704 and 706 depict discharge currents (Idis) corresponding to plots 700 and 702, respectively.

As soon as Vreg_out begins to overshoot, at t0, the discharge current begins. For plot 700, at t1, the discharge current is terminated as Vreg_out returns to Vreg. For plot 702, at t2, the discharge current is terminated as Vreg_out returns to Vreg. The overshoot of plot 700 is advantageously terminated before the overshoot of plot 702.

Figure 7B:
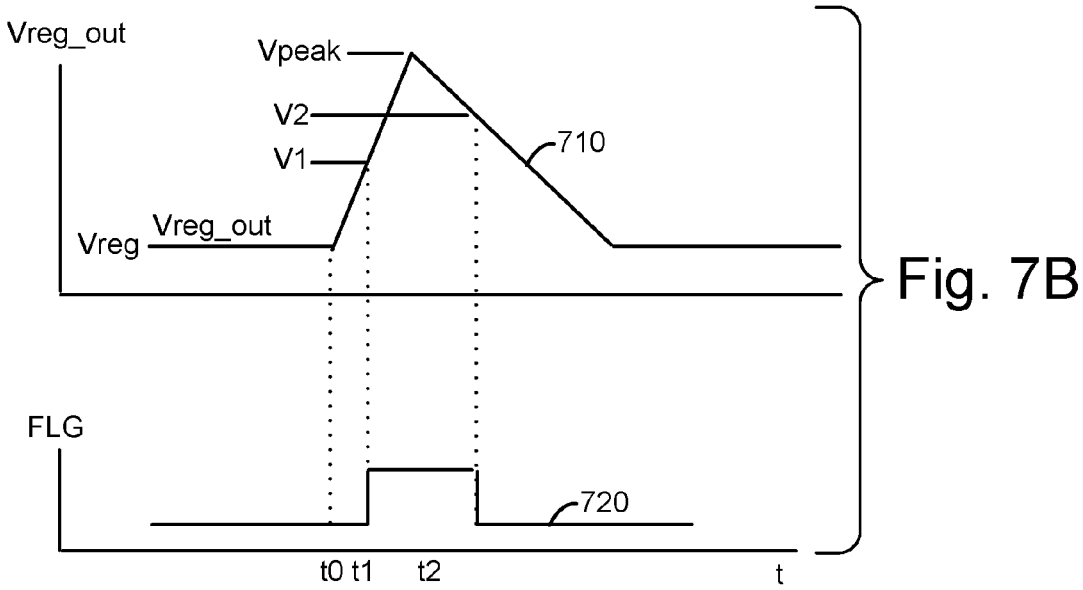
FIG. 7B depicts another example waveform showing discharge of a voltage overshoot.

FIG. 7B depicts another example waveform 710 showing discharge of a voltage overshoot. A plot 720 represents the flag (FLG). Before a time t0, the output, Vreg_out is at a regulated level, Vreg. At t0, Vreg_out begins to overshoot, e.g., due to coupling from another conductive path. Vreg_out increases to a peak level, Vpeak, then decreases and eventually stabilizes at Vreg. At t1, Vreg_out increases above V1 (a first voltage) so the flag goes high. At t2, Vreg_out subsequently falls below V2 (a second voltage), so that the flag goes low. In this case, the threshold V2 is greater than the threshold V1. The current on the path 516 similarly increases above a threshold which corresponds to V2−Vreg at t1, and subsequently falls below a threshold which corresponds to V2−Vreg at t2. By setting V2>V1, a hysteresis is provided. Additionally, undershoot is avoided since the discharge path is turned off relatively sooner than if V2=V1. Alternatively, V1=V2 or V1>V2. For example, assume Vreg=1 V. V1 may be 1 V+20 mV and V2 may be 1 V+30 mV.

Figure 8A:
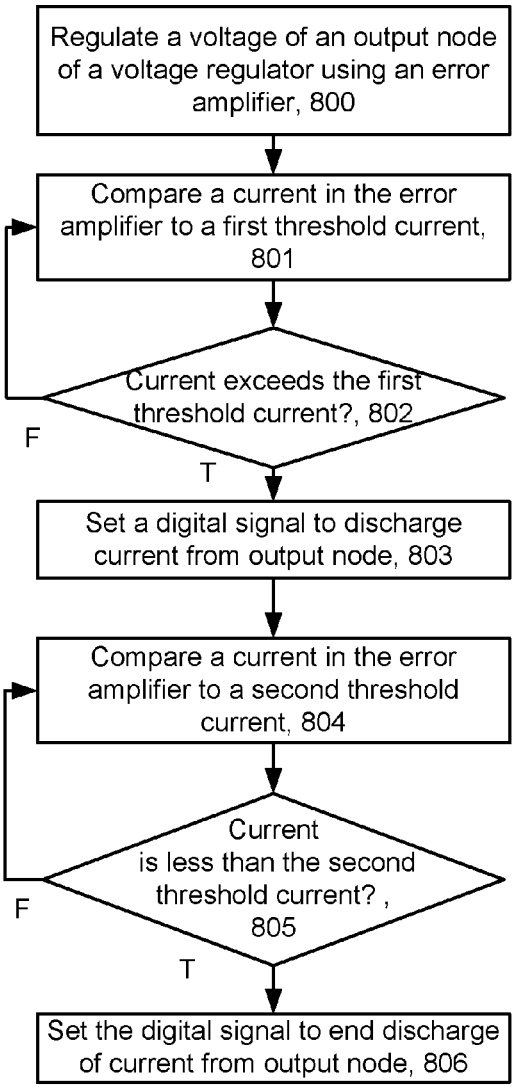
FIG. 8A depicts an example process for discharging a voltage overshoot, consistent with the circuit of FIG. 5.

FIG. 8A depicts an example process for discharging a voltage overshoot, consistent with the circuit of FIG. 5. Step 800 includes regulating a voltage of an output node of a voltage regulator using an error amplifier. Step 801 includes comparing a current in the error amplifier to a first threshold current. A decision step 802 determines whether the current exceeds the first threshold current. If decision step 802 is false (F), step 801 is repeated. If decision step 802 is true (T), step 803 sets a digital signal to discharge current from the output node. Step 804 compares a current in the error amplifier to a second threshold current. A decision step 805 determines whether the current is less than the second threshold current. If decision step 805 is false, step 804 is repeated. If decision step 805 is true, step 806 sets the digital signal to end the discharges of current from the output node.

A method thus includes regulating a voltage at an output node of a voltage regulator using an error amplifier; comparing a current in the error amplifier to one or more comparison currents; and based on the comparing, setting a flag which controls a discharge path connected to the output node, wherein the flag enables the discharge path when the flag has one value (e.g., 1) and the flag disables the discharge path when the flag has another value (e.g., 0).

Figure 8B:
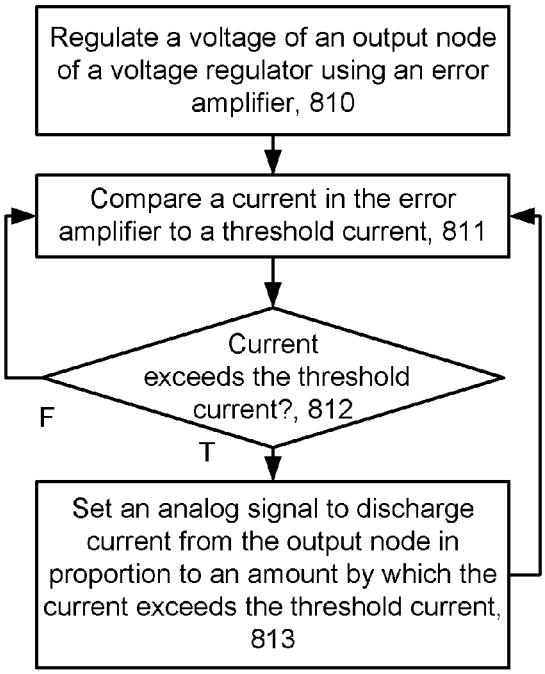
FIG. 8B depicts an example process for discharging a voltage overshoot, consistent with the circuit of FIG. 6.

FIG. 8B depicts an example process for discharging a voltage overshoot, consistent with the circuit of FIG. 6. Step 810 includes regulating a voltage of an output node of a voltage regulator using an error amplifier. Step 811 includes comparing a current in the error amplifier to a threshold current. This can be Iref or another current. A decision step 812 determines whether the current exceeds first threshold current. If decision step 812 is false, step 811 is repeated. If decision step 812 is true, step 813 sets an analog signal to discharge current from the output node in proportion to an amount by which the current exceeds the threshold current. Thus, the discharge control circuit is configured to enable a current in the discharge path in proportion to an amount by which the current in the error amplifier exceeds the threshold.

Figure 9:
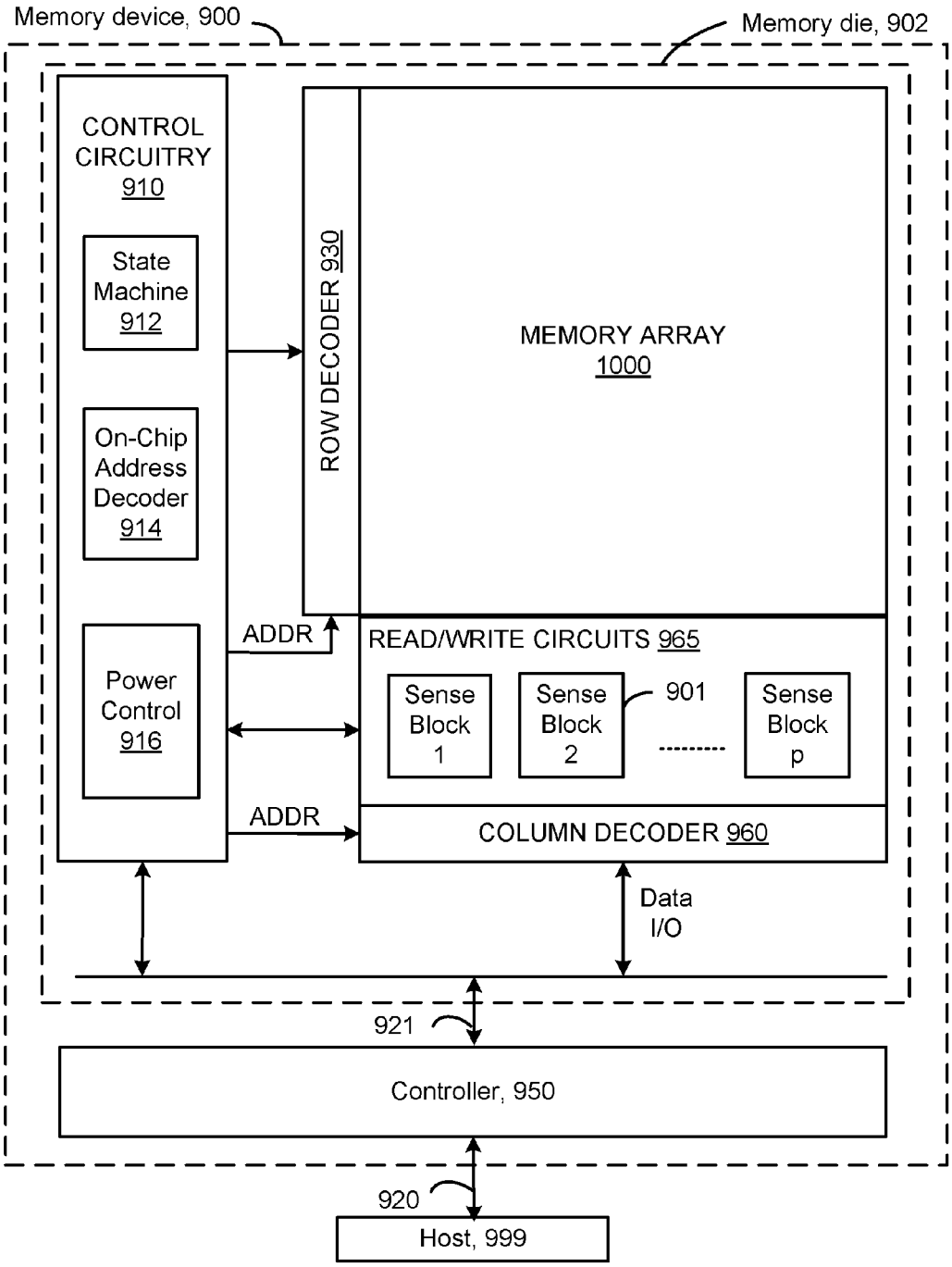
FIG. 9 is a block diagram of a non-volatile memory system using single row/column decoders and read/write circuits, as an example of the die of FIG. 1.

FIG. 9 is a block diagram of a non-volatile memory system using single row/column decoders and read/write circuits, as an example of the die of FIG. 1. The system may include many blocks of storage elements. A memory device 900 has read/write circuits for reading and programming a page of storage elements in parallel, and may include one or more memory die 902. Memory die 902 includes a two-dimensional array 1000 of storage elements, which may include several of the blocks 1001 of FIG. 10, control circuitry 910, and read/write circuits 965. In some embodiments, the array of storage elements can be three dimensional. The memory array is addressable by word lines via a row decoder 930 and by bit lines via a column decoder 960. The read/write circuits 965 include multiple sense blocks 901 and allow a page of storage elements to be read or programmed in parallel. Typically a controller 950 is included in the same memory device (e.g., a removable storage card) as the one or more memory die. Commands and data are transferred between the host 999 and controller 950 via lines 920 and between the controller and the one or more memory die via lines 921.

The control circuitry 910 cooperates with the read/write circuits 965 to perform operations on the memory array. The control circuitry 910 includes a state machine 912, an on-chip address decoder 914 and a power control circuit 916. For example, the power control circuit may include one or more voltage regulators as described herein. The state machine 912 provides chip-level control of memory operations. For example, the state machine may be configured to perform read and verify processes. The on-chip address decoder 914 provides an address interface between that used by the host or a memory controller to the hardware address used by the decoders 930 and 960. The power control circuit 916 controls the power and voltages supplied to the word lines and bit lines during memory operations.

In some implementations, some of the components of FIG. 9 can be combined. In various designs, one or more of the components (alone or in combination), other than memory array 1000, can be thought of as a managing or control circuit. For example, one or more managing or control circuits may include any one of, or a combination of, control circuitry 910, state machine 912, decoders 914/960, power control circuit 916, sense blocks 901, read/write circuits 965, controller 950, host controller 999, and so forth.

The data stored in the memory array is read out by the column decoder 960 and output to external I/O lines via the data I/O line and a data input/output buffer. Program data to be stored in the memory array is input to the data input/output buffer via the external I/O lines. Command data for controlling the memory device are input to the controller 950. The command data informs the flash memory of what operation is requested. The input command is transferred to the control circuitry 910. The state machine 912 can output a status of the memory device such as READY/BUSY or PASS/FAIL. When the memory device is busy, it cannot receive new read or write commands.

In another possible configuration, a non-volatile memory system can use dual row/column decoders and read/write circuits. In this case, access to the memory array by the various peripheral circuits is implemented in a symmetric fashion, on opposite sides of the array, so that the densities of access lines and circuitry on each side are reduced by half.

Figure 10:
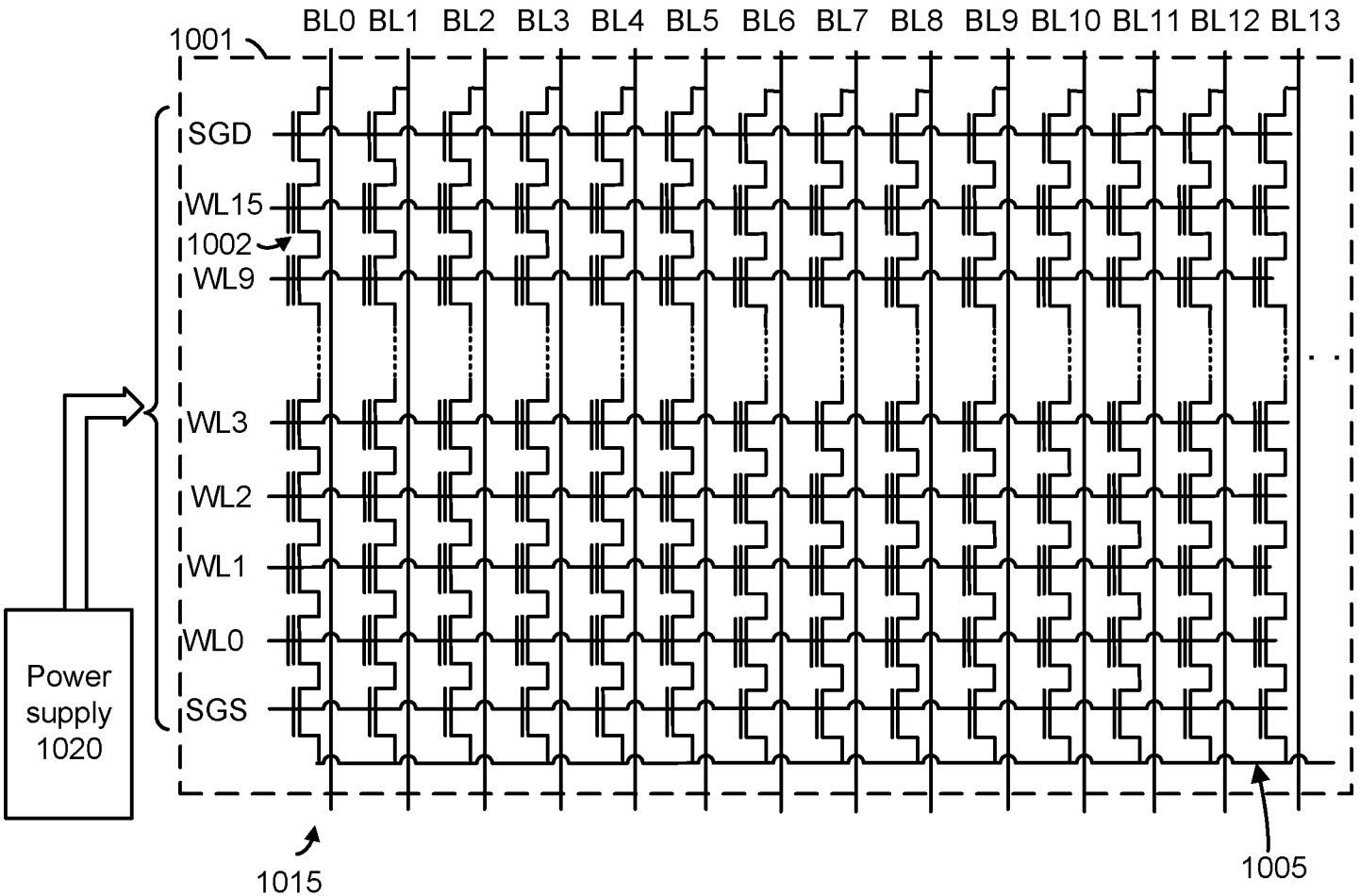
FIG. 10 depicts a block of memory cells in an example configuration of the memory array 1000 of FIG. 9.

FIG. 10 depicts a block 1001 of memory cells in an example configuration of the memory array 1000 of FIG. 9. As mentioned, a voltage regulator provides an output voltage which is different from a supply or input voltage. In one example application, a power supply 1020 is used to provide voltages at different levels during erase, program or read operations in a non-volatile memory device such as a NAND flash EEPROM. The power supply can include one or more voltage regulator circuits as described herein. In such a device, the block includes a number of storage elements which communicate with respective word lines WL0-WL15, respective bit lines BL0-BL13, and a common source line 1005. An example storage element 1002 is depicted. In the example provided, sixteen storage elements are connected in series to form a NAND string (see example NAND string 1015), and there are sixteen data word lines WL0 through WL15. Moreover, one terminal of each NAND string is connected to a corresponding bit line via a drain select gate (connected to select gate drain line SGD), and another terminal is connected to a common source 1005 via a source select gate (connected to select gate source line SGS). Thus, the common source 1005 is coupled to each NAND string. The block 1001 is typically one of many such blocks in a memory array.

In an erase operation, a high voltage such as 20 V is applied to a substrate on which the NAND string is formed to remove charge from the storage elements. During a programming operation, a voltage in the range of 12-21 V is applied to a selected word line. In one approach, step-wise increasing program pulses are applied until a storage element is verified to have reached an intended state. Moreover, pass voltages at a lower level may be applied concurrently to the unselected word lines. In read and verify operations, the select gates (SGD and SGS) are connected to a voltage in a range of 2.5 to 4.5 V and the unselected word lines are raised to a read pass voltage, Vread, (typically a voltage in the range of 4.5 to 6 V) to make the transistors operate as pass gates. The selected word line is connected to a voltage, a level of which is specified for each read and verify operation, to determine whether a Vth of the concerned storage element is above or below such level.

In practice, the output of a voltage regulator may be used to provide different voltages concurrently to different word lines or groups of word lines. It is also possible to use multiple voltage regulators to supply different word line voltages.

Figure 11:
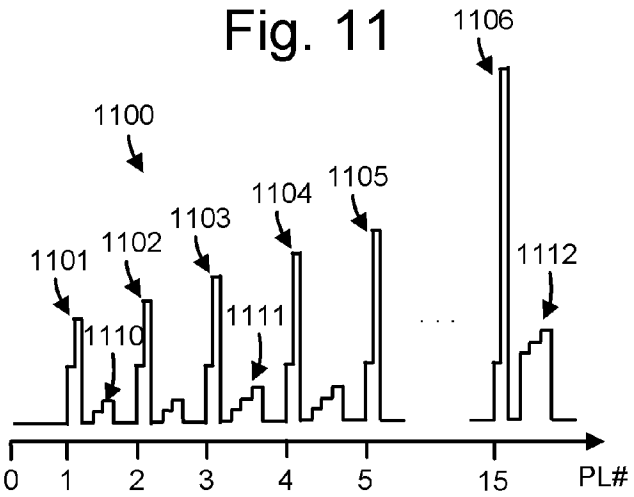
FIG. 11 depicts an example waveform in a programming operation using program and verify voltages which are provided by a power supply.

FIG. 11 depicts an example waveform in a programming operation using program and verify voltages which are provided by a power supply. The horizontal axis depicts a program loop (PL) number and the vertical axis depicts control gate or word line voltage. Generally, a programming operation can involve applying a pulse train to a selected word line, where the pulse train includes multiple program loops or program-verify iterations. The program portion of the program-verify iteration comprises a program voltage, and the verify portion of the program-verify iteration comprises one or more verify voltages.

Each program voltage includes two steps, in one approach. Further, Incremental Step Pulse Programming (ISPP) is used in this example, in which the program voltage steps up in each successive program loop using a fixed or varying step size. This example uses ISPP in a single programming pass in which the programming is completed. ISPP can also be used in each programming pass of a multi-pass operation.

The waveform 1100 includes a series of program voltages 1101, 1102, 1103, 1104, 1105, . . . 1106 that are applied to a word line selected for programming and to an associated set of non-volatile memory cells. One or more verify voltages can be provided after each program voltage as an example, based on the target data states which are being verified. 0 V may be applied to the selected word line between the program and verify voltages. For example, S1- and S2-state verify voltages of VvS1 and VvS2, respectively, (waveform 1110) may be applied after each of the program voltages 1101 and 1102. S1-, S2- and S3-state verify voltages of VvS1, VvS2 and VvS3 (waveform 1111) may be applied after each of the program voltages 1103 and 1104. After several additional program loops, not shown, S5-, S6- and S7-state verify voltages of VvS5, VvS6 and VvS7 (waveform 1112) may be applied after the final program voltage 1106.

Figure 12:
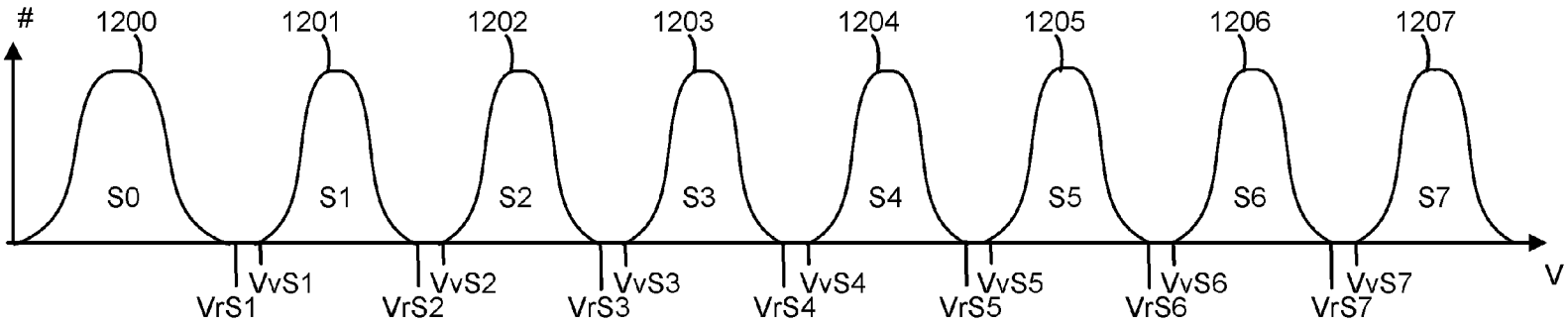
FIG. 12 depicts example threshold voltage (Vth) distributions of memory cells for a case with eight data states, showing read and verify voltages which may be provided by a power supply.

FIG. 12 depicts example Vth distributions of memory cells for a case with eight data states, showing read and verify voltages which may be provided by a voltage regulator circuit. This example has eight data states, S0-S7. The S0, S1, S2, S3, S4, S5, S6 and S7 states are represented by the Vth distributions 1200, 1201, 1202, 1203, 1204, 1205, 1206, 1207, respectively, have verify voltages of VvS1, VvS2, VvS3, VvS4, VvS5, VvS6 and VvS7, respectively, and have read voltages of VrS1, VrS2, VrS3, VrS4, VrS5, VrS6 and VrS7, respectively. Pass voltages may also be provided by a voltage regulator circuit. A pass voltage is high enough to provide a memory cell in a strongly conductive state.

The foregoing detailed description of the invention has been presented for purposes of illustration and description. It is not intended to be exhaustive or to limit the invention to the precise form disclosed. Many modifications and variations are possible in light of the above teaching. The described embodiments were chosen to best explain the principles of the invention and its practical application, to thereby enable others skilled in the art to best utilize the invention in various embodiments and with various modifications as are suited to the particular use contemplated. It is intended that the scope of the invention be defined by the claims appended hereto.

What is claimed is:

1. An apparatus, comprising:

an error amplifier comprising an inverting input, a non-inverting input and an output, the non-inverting input configured to receive a reference voltage and the inverting input configured to receive a feedback signal based on a voltage of the output;

a power stage connected to the output of the error amplifier;

an output node connected to the power stage and to a load;

a discharge path connected to the output node; and a control circuit configured to enable the discharge path in response to a current in the error amplifier satisfying a turn on threshold, and disable the discharge path in response to the current in the error amplifier satisfying a turn off threshold, wherein the control circuit comprises a current sink, and the current sink is configured to sink a first current when the discharge path is enabled and to sink a second current, less than the first current, when the discharge path is disabled.

2. The apparatus of claim 1, wherein:

the control circuit configured to enable the discharge path in response to the current in the error amplifier satisfying the turn on threshold, and disable the discharge path in response to the current in the error amplifier satisfying the turn off threshold, different than the turn on threshold.

3. The apparatus of claim 2, wherein:

the turn off threshold is greater than the turn on threshold.

4. The apparatus of claim 1, wherein:

the control circuit comprises a pair of inverters;

the current sink is connected to an input to the pair of inverters; and the current in the error amplifier is a current source to the input to the pair of inverters.

5. The apparatus of claim 4, wherein:

the current sink comprises a fixed current sink and a switchable current sink;

the switchable current sink is connected to a path which is between the inverters;

the path between the inverters is high when the discharge path is disabled and low when the discharge path is disabled;

when the path between the inverters is high, the switchable current sink is configured to sink a first current; and when the path between the inverters is low, the switchable current sink is not configured to sink a current.

6. The apparatus of claim 1, wherein:

the current in the error amplifier mirrors a current source to the output of the error amplifier.

7. The apparatus of claim 6, wherein:

the current at the output of the error amplifier is in a path comprising push-pull transistors.

8. The apparatus of claim 1, wherein:

the discharge path comprises a current sink and a transistor; and a gate of the transistor is connected to the control circuit.

9. The apparatus of claim 1, wherein:

the control circuit configured to enable a current in the discharge path in proportion to an amount by which the current in the error amplifier exceeds the turn on threshold.

10. A method, comprising:

regulating a voltage at an output node of a voltage regulator using an error amplifier;

determining when the voltage of the output node is coupled up above a regulated voltage to a first voltage;

enabling a discharge path connected to the output node when the voltage of the output node is coupled up above the regulated voltage to the first voltage;

determining when the voltage of the output node falls below a second voltage which is greater than the regulated voltage and the first voltage; and disabling the discharge path when the voltage of the output node falls below the second voltage.

11. An apparatus, comprising:

an error amplifier, the error amplifier comprising a first output, a second output, an inverting input and a non-inverting input;

a power stage connected to the error amplifier and to an output node; and a discharge path connected to the output node, wherein the first output is configured to control the power stage and the second output is configured to control the discharge path, and the error amplifier comprises means for detecting a level of a current in the error amplifier and means for setting a signal on the second output in response to the means for detecting the level of the current, wherein the signal has a first value when the current increases above a first threshold and the signal has a second value when the current subsequently falls below a second threshold.

12. The apparatus of claim 11, wherein:

the discharge path is enabled when the signal has the first value and disabled when the signal has the second value.

13. The apparatus of claim 11, wherein:

the second threshold is greater than the first threshold.

14. The apparatus of claim 11, wherein:

the current is on a path which mirrors a current source to the first output.

15. The apparatus of claim 14, wherein:

the second threshold is greater than the first threshold; and the means for detecting the level of the current in the error amplifier comprises means for sinking a first current on the path when the current in the error amplifier does not exceed the first threshold and means for sinking a second current on the path when the current in the error amplifier increases above the first threshold but has not yet fallen below the second threshold.

16. The apparatus of claim 15, wherein:

the means for detecting the level of the current in the error amplifier comprises means for sinking the first current on the path when the current in the error amplifier falls below the second threshold.

* * * * *